US005579829A

United States Patent [19]

Comeau et al.

[11] Patent Number: 5,579,829

[45] Date of Patent: Dec. 3, 1996

[54] KEYLESS LATCH FOR ORIENTING AND ANCHORING DOWNHOLE TOOLS

[75] Inventors: Laurier E. Comeau, Leduc; Elis Vandenberg, Sherwood Park, both of Canada

[73] Assignee: Baroid Technology, Inc., Houston, Tex.

[21] Appl. No.: 496,504

[22] Filed: Jun. 29, 1995

[51] Int. Cl.[6] ..... E21B 7/08

[52] U.S. Cl. ..... 166/117.6; 166/214; 166/237; 166/255.3

[58] Field of Search ..... 166/214, 237, 166/255.2, 255.3, 242.1, 117.6

[56] References Cited

U.S. PATENT DOCUMENTS

| | | | |
|---|---|---|---|
| 1,851,319 | 3/1932 | McCoy et al. | 166/255.3 |
| 2,862,564 | 12/1958 | Bostock | 166/214 |
| 3,070,166 | 12/1962 | Knauth | 166/255.3 |
| 3,143,170 | 8/1964 | Nelson | 166/255.2 |
| 4,303,299 | 12/1981 | Holland et al. | 166/255.3 |
| 4,369,840 | 1/1983 | Szarka et al. | 166/240 X |
| 4,415,205 | 11/1983 | Rehm et al. | 299/5 |
| 4,896,721 | 1/1990 | Welch | 166/214 |
| 5,390,742 | 2/1995 | Dines et al. | 166/242.1 |

*Primary Examiner*—Hoang C. Dang
*Attorney, Agent, or Firm*—Browning Bushman

[57] ABSTRACT

A keyless latch assembly automatically aligns and fixes the axial and circumferential position of a whipstock within a surrounding casing joint. Alignment and fixing of the whipstock ensures proper engagement and orientation of a drill bit relative to an access window formed in the casing wall. Spring loaded latches in the assembly register with and extend into corresponding receiving recesses formed on the inner surface of the casing joint. The recesses, which are spaced circumferentially around the interior of the casing joint, contain differing profiles that uniquely mate with corresponding profiles on the latches. The position of the latches relative to the recesses determines the amount of radial latch movement which controls the anchoring and orientation of the assembly within the casing. Confirmation of correct axial location and proper circumferential orientation may be made by surface monitoring of the setting string weight and turning torque. The spring loaded latches release from anchored, oriented position in response to an upward axial force exerted by the drill string to provide a straight pull release of the assembly.

11 Claims, 9 Drawing Sheets

FIG. 17
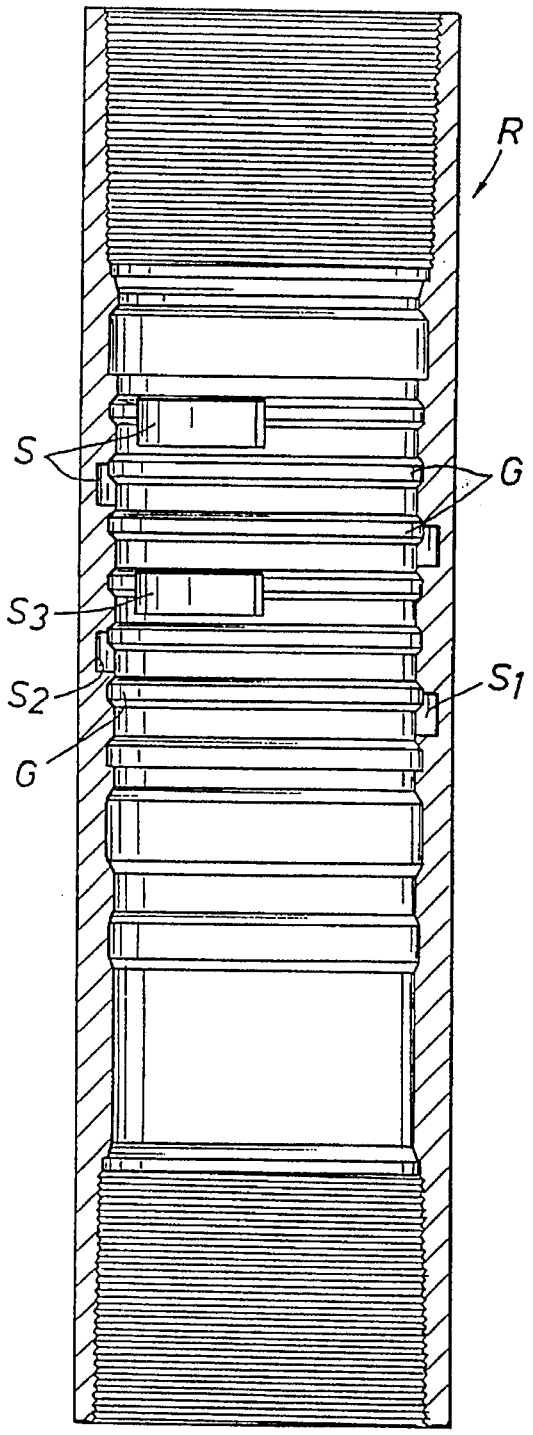
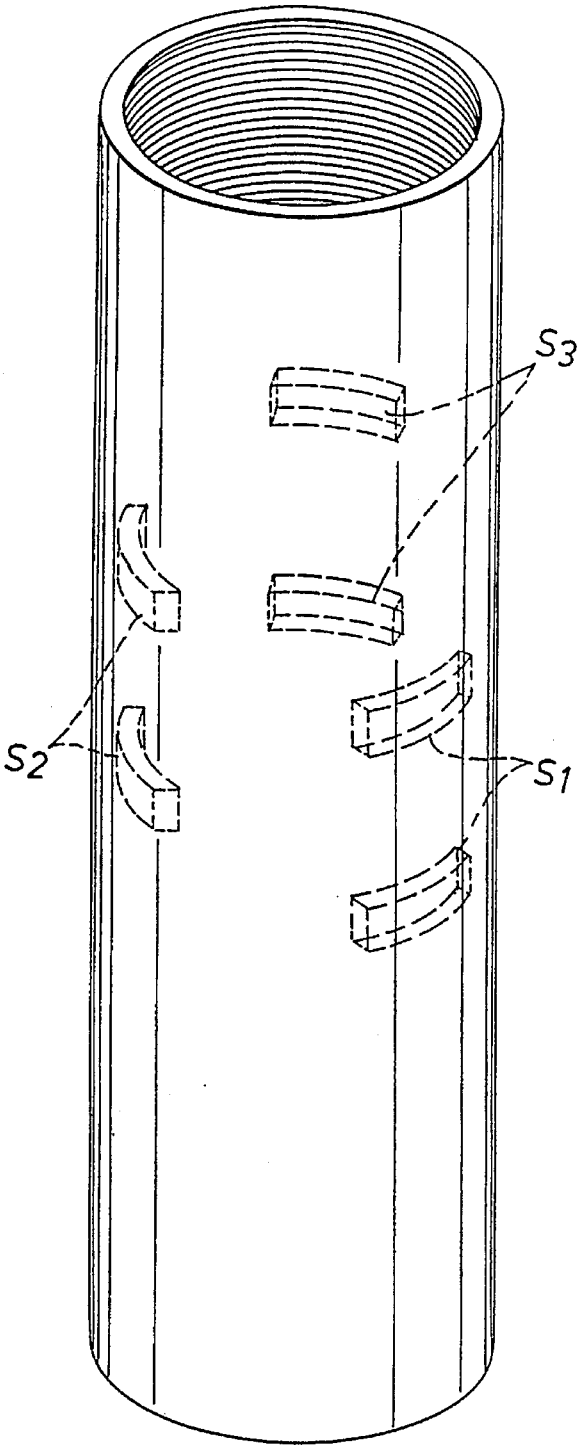
FIG. 18

KEYLESS LATCH FOR ORIENTING AND ANCHORING DOWNHOLE TOOLS

RELATED APPLICATIONS

This application contains subject matter common to that contained in U.S. application Ser. No. 08/496,775, filed on Jun. 29, 1995, entitled INTERNAL PRESSURE SLEEVE FOR USE WITH EASILY DRILLABLE EXIT PORTS, in the names of Larry Comeau, et al.

BACKGROUND OF THE INVENTION

This invention relates generally to apparatus used in drilling lateral wells from vertical wells, for purposes of producing oil and gas from subsurface formations.

Since its usage began, horizontal drilling has offered dramatic reservoir-exposure improvements. Lately, a new trend has developed towards drilling multiple laterals, thus further increasing production. Until recently, laterals typically were not cased and tied back, which meant when workovers or cleanouts were required, re-entry was difficult and completions were virtually impossible.

Now, the technology allows multiple laterals to be cased and tied back. Multilaterals may be drilled into predetermined producing-formation quadrants at any time in the productive life cycle of wells and can be used in vertical, directional or horizontal applications.

Minimizing the distance hydrocarbons must travel to the wellbore is an important goal. One surface hole installation can now incorporate an integral casing drainage system that takes the wellbore to the hydrocarbons in place.

The same directional bottomhole assembly used to initiate the kickoff is used to drill the build or turn portion of the lateral wellbore. Once a lateral has been drilled, a secondary liner and hanger system is placed into the newly drilled wellbore and mechanically tied back to the main casing string, allowing future re-entry into the new leg. The deflection device can immediately be moved to the next window joint upon installation of the lateral string.

Either the drilling cycle can commence on the next lateral, or the deflection device can be retrieved to surface, enabling access to all casing strings. The deflection device can, alternatively, be left on bottom, to be available if additional laterals are drilled at some other time, to further improve reservoir recovery based on performance of the original wellbore and its added lateral or laterals.

Additional benefits are that the system creates a natural separator for oil and gas production in vertical applications, and it creates the opportunity to drill, complete and produce from several different formations tied to one surface-hole casing string.

An integral part of the system for drilling either a single lateral well, or a multiple lateral well scenario, is the so-called casing window joint, a joint of steel casing having a pre-cut or pre-formed window which is easily drillable. The casing window system is available in various oilfield-tubular material grades. The completed casing window is the overwrapped with composite materials (similar to fiberglass).

PRIOR ART

As noted in U.S. Pat. No. 4,415,205, indexing mechanisms for locating and orienting tools for formation of lateral well bores are well known in the prior art. Typically, such designs use internally projecting keys formed on the internal wall of the surrounding pipe which engage the downhole tool to establish correct lateral or axial tool positioning. U.S. Pat. No. 4,415,205 describes a typical application which employs an internally projecting key which extends radially inwardly from the casing wall for orienting and positioning a whipstock.

While providing adequate precision for their intended purpose, these keys restrict the internal clearance through the casing. Where large forces are to be encountered, one or more relatively large projections may be required to withstand the applied loads further obstructing the internal clearance of the casing. These internal restrictions, whether, one or many, can interfere with work to be performed within the well pipe. Moreover, projections extending into the casing are subject to being damaged or destroyed by tools working in the casing rendering the projections useless for their intended purpose.

The use of projecting keys also limits the type of equipment which may be passed through the well pipe. Full drift tools obviously may not be lowered below such projections. Where the well casing is equipped with multiple setting keys at different axially spaced locations, relatively complex setting tools are required for selectively placing or operating the subsurface assembly at the lower locations.

From the foregoing, it will be appreciated that a primary object of the present invention is to provide a means for physically holding and orienting a subsurface device such as a whipstock within a surrounding well pipe without the use of clearance restricting projections extending inwardly from the pipe wall.

Another object of this invention is to provide a system for anchoring and orienting a subsurface assembly within a well bore by the use of only axial and one-way rotational movement of a surface operated setting tool.

An important object of the present invention is to provide an assembly which may be set at a subsurface location and confirmed to be set properly by monitoring axial and rotational forces exerted by the setting tool.

It is also an object of this invention to provide a subsurface assembly which can selectively be axially moved past one or more subsurface anchoring recesses without being set.

An object of the invention is to provide an assembly with biased latches which reach full outward extension only when each and every latch is properly aligned with its own corresponding recess in the casing wall.

It is also an object of the invention to provide a keyless anchoring and orientation system which allows surface confirmation that the assembly is at a desired subsurface depth location and that the circumferential orientation of the assembly is correct.

SUMMARY OF THE INVENTION

The keyless latch assembly of the present invention cooperates with circumferentially spaced recesses formed on the internal surface of a well pipe to locate, anchor and orient the assembly and any tool attached thereto. The design of the recesses and latches on the assembly function together to ensure that, when fully anchored, the assembly is properly positioned axially as well as circumferentially relative to the surrounding well pipe.

The assembly may be moved axially past any set of recesses without setting by rotating the setting string so that the latches are not aligned with their corresponding recesses as they traverse the recessed area. When the assembly has been set, a direct, nonrotational lifting force on the setting string causes release of the assembly from its surrounding recesses. Upward release movement of the assembly is permitted due to the engagement of tapered shoulders between the latches and their recesses. Downward movement of the anchored assembly is prevented by the engagement of square shouldered surfaces on the latches and recesses. The amount of force required to release the tool can be altered as required by changing the spring forces acting to extend the latches outwardly into their recesses or by altering the surface contact areas between the latches and recesses.

An important feature of the present invention is its ability to confirm proper anchoring and orientation of the assembly by simple right hand rotation of the setting string. An increase in axial forces required to move the string up or down confirms engagement of the assembly with the recess area. A sharp increase in the torque normally required to rotate the assembly confirms proper orientation of the assembly as well as anchoring.

These and other objects, features and advantages of the present invention may be more fully appreciated and understood by reference to the following drawings, description and claims.

BRIEF DESCRIPTION OF THE DRAWINGS

These and other objects, features and advantages of the present invention will be more readily appreciated from a reading of the detailed specification, in conjunction with the drawings, in which:

FIG. 17 is a detailed elevation, in cross-section, illustrating details in the internal coupling recesses; and FIG. 18 is an isometric view illustrating the circumferential spacing and axial positioning of internal recess slots formed on the inner surface of the casing.

DETAILED DESCRIPTION OF THE PREFERRED EMBODIMENT

Figure 1:
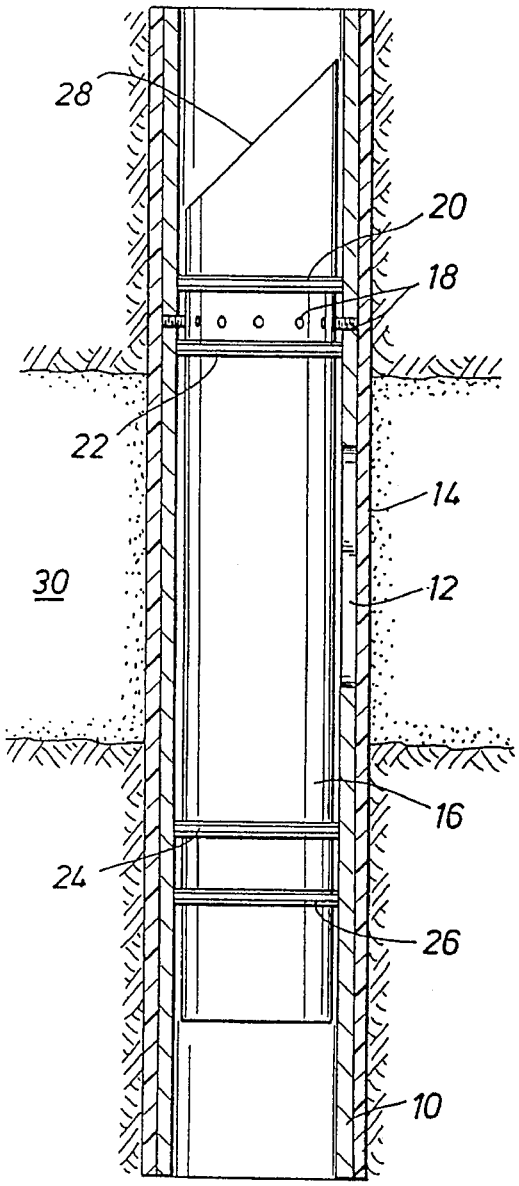
FIG. 1 is a simplified, elevated, diagrammatic view, partly in cross-section, of an internal pressure sleeve according to the present invention, in place in the interior of a casing having a pre-cut, easily drillable hole therein.

Referring now to FIG. 1, a tubular, steel casing 10 is illustrated as having a pre-cut or pre-formed hole 12 therein. The outer surface of the casing 10 is wrapped with one or more layers of fiberglass 14, thus providing the easy exit port 12 through the casing 10.

The tubular sleeve 16 is located within the interior of the casing 10, held in place by a plurality of set screws 18 which pin the sleeve 16 to the casing. O-rings 20, 22, 24 and 26 prevent any liquids or gasses from passing along the annular space between the casing 10 and the tubular sleeve 16 coming from the exit port 12. A conventional muleshoe 28 is located at the upper end of the tubular sleeve for rotating the casing 10 and the sleeve 16 as appropriate.

In the operation of the system diagrammatically illustrated in FIG. 1, the internal sleeve 16 is pinned in place at the earth's surface. The combined casing 10 and sleeve 16 is then run into an earth borehole, already drilled by conventional methods, until the exit port 12 is located at the desired vertical depth, within the region of interest 30 in the earth formation. The orientation of the exit port 12 is determined by causing survey instruments to land on the muleshoe 28. By rotating the casing string from the earth's surface, the exit window is thus oriented. Once the exit port 12 is correctly oriented, the casing is typically cemented in place, in the earth borehole, after which a conventional fishing tool is run from the earth's surface, down through the casing 10, the internal sleeve 16, and out the lower end of the sleeve 16. Although the fishing tool (not illustrated) can take various forms, a typical fishing tool for this operation can have one-way dogs, which spring up upon exiting the lower end of the sleeve 16, and actually grapple the lower end of sleeve 16. By pulling up on the fishing tool, the set screws 18 will shear out and the internal pressure sleeve can be retrieved to the earth's surface.

Figure 8:
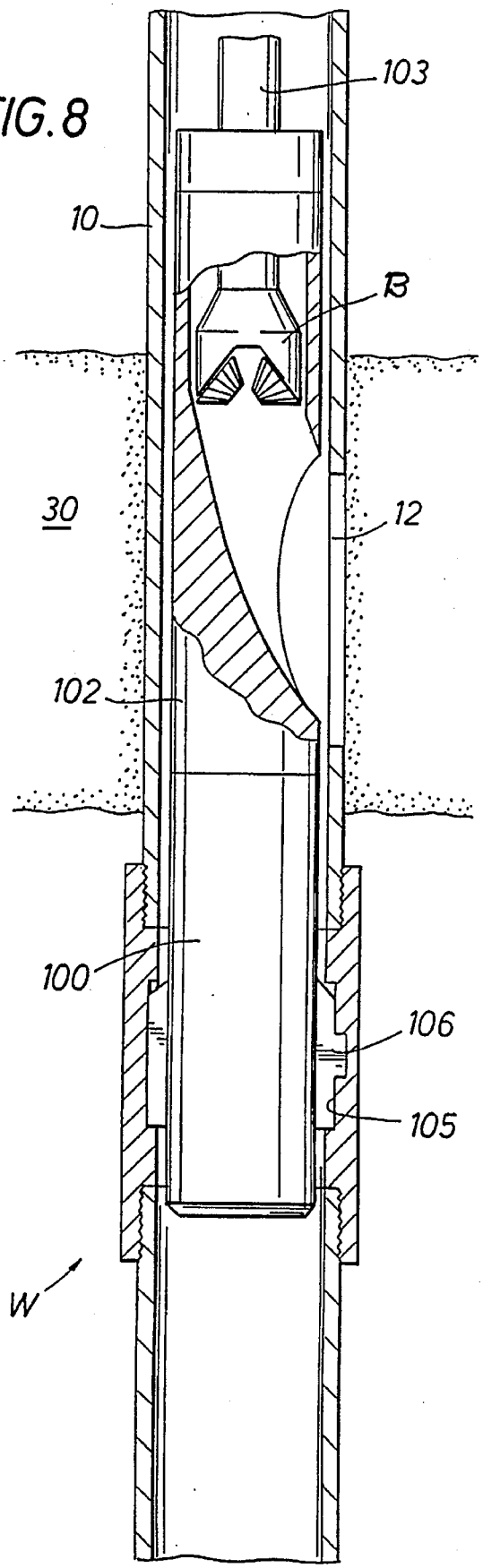
FIG. 8 is a generalized schematic view, partially cut away, illustrating the assembly of the present invention being used to locate, anchor and orient a whipstock within a specially recessed casing joint.

Following retrieval of the internal pressure sleeve 16, a conventional whipstock, such as is illustrated in FIG. 8 is lowered through the casing 10, and once oriented with the orientation of the exit port 12, for example, through the use of a conventional key lug on the interior of the casing 10, is anchored immediately below the exit port 12. With the whipstock anchored in place and its running tool retrieved from the borehole, a conventional drilling operation is commenced, in which a drill bit at the lower end of a drillstring is lowered down to the whipstock and caused to drill off the whipstock, through the fiberglass covered exit port 12, any cement outside the exit port, and into the formation of interest 30. To replace the conventional key lug, the present invention contemplates that a keyless orienting and latching system as described hereinafter be used.

Those skilled in the art will recognize that this system can function without the use of the fiberglass layer or layers 14. However, the preferred embodiment makes use of the fiberglass layer to keep debris in the borehole from entering the exit port into the annulus between the casing 10 and sleeve 16, in between the O-ring 22 and the O-ring 24.

As an additional feature of the invention, a generally incompressible oil or grease is placed in the exit port 12 prior to wrapping the casing 10 with the fiberglass, thus preventing the fiberglass layer 14 from deforming into the exit port 12 when exposed to high pressures external thereto.

Figure 2:
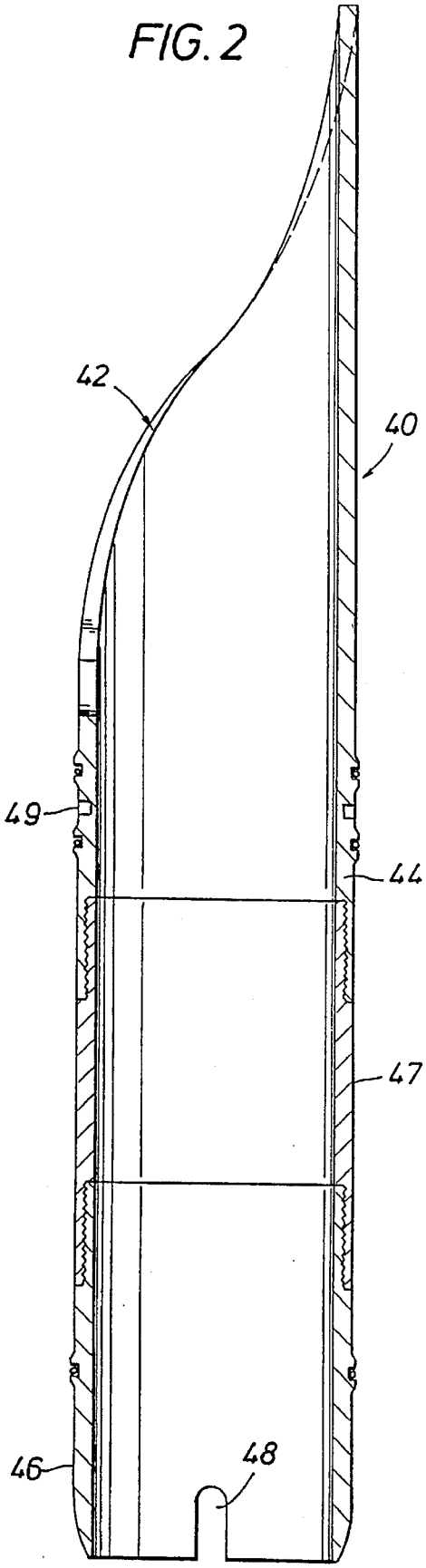
FIG. 2 is an elevated, cross-sectional view of the internal pressure sleeve according to the present invention.

Referring now to FIG. 2, the preferred embodiment of an internal pressure sleeve assembly 40 illustrated in greater detail than that of the schematic representation of sleeve 16 in FIG. 1. The sleeve assembly 40 has a muleshoe 42 at the upper end of an upper coupling 44. A lower coupling 46, at the lower end of the sleeve assembly 40, has a pair of wrench slots 48, indexed at 180°, for tightening the parts of the assembly 40. Intermediate the upper coupling 44 and the lower coupling 46 is a sleeve 47.

Figure 3:
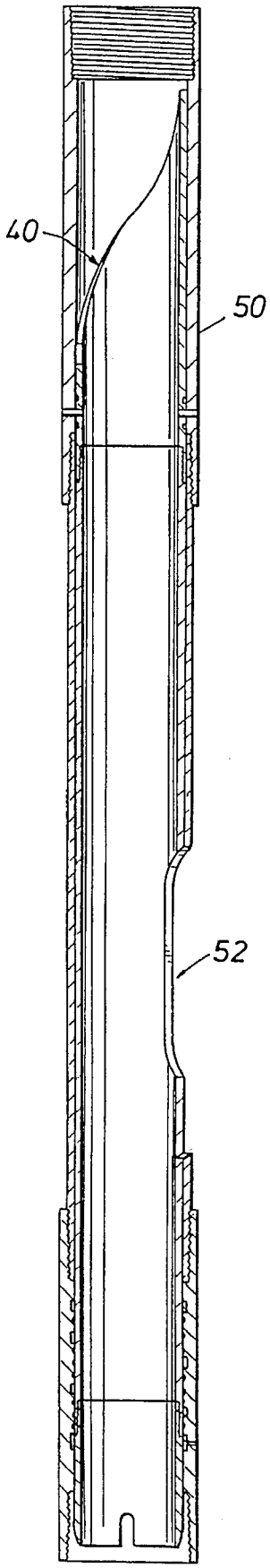
FIG. 3 is an elevated, cross-sectional view of the internal pressure sleeve of FIG. 2, in place in the interior of a casing having a pre-cut, easily drillable hole therein.

The tapped holes 49 in the upper coupling 44 receive the set screws (not illustrated in this drawing figure) which are used for attaching the sleeve assembly 40 to the casing, illustrated together in FIG. 3.

Referring now to FIG. 3, the sleeve assembly 40 is illustrated as being pinned to a casing joint 50 having a window (exit port) 52, prior to the casing 50 being wrapped with a composite material, for example, fiberglass.

Figure 4:
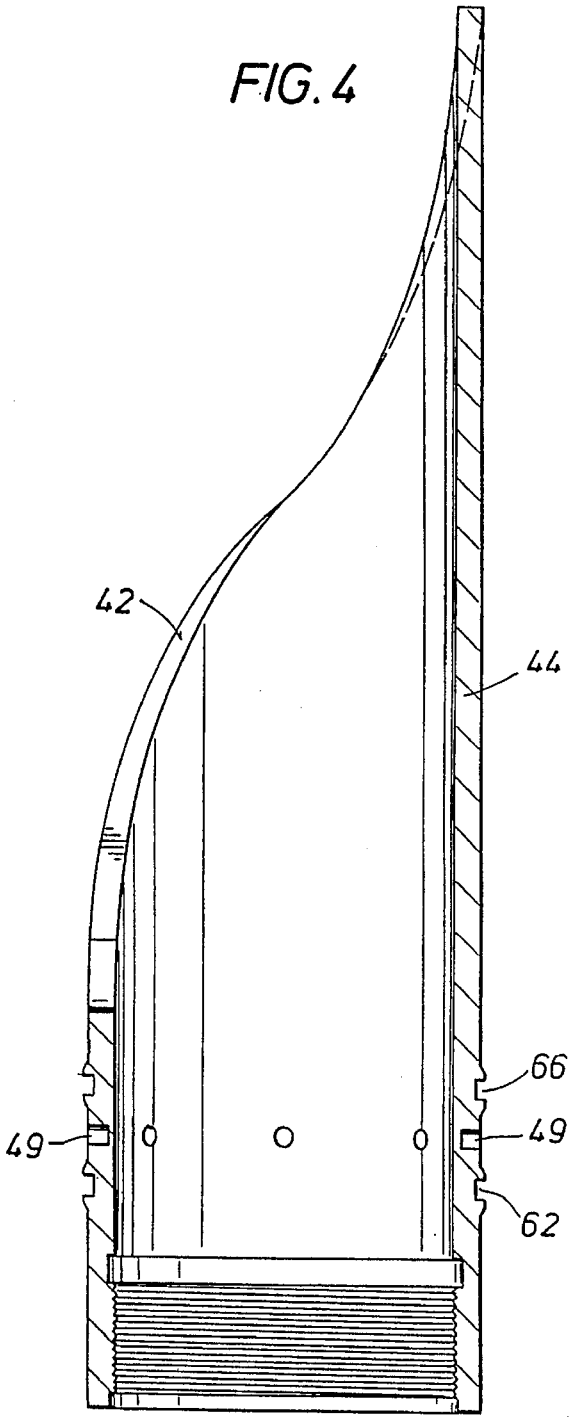
FIG. 4 is an enlarged, elevated, cross-sectional view of the upper coupling portion of the internal pressure sleeve according to FIG. 2.

Referring now to FIG. 4, the upper coupling portion 44 of the sleeve assembly 40 is illustrated in greater detail. The muleshoe 42, used for determining the orientation of the exit port in the casing, is a 44.000 lead taper, single muleshoe. The O-ring receptacles 66 and 62 are formed on opposing sides to the tapered holes 49 which receive the set screws for attaching the sleeve assembly 40 to the casing joint 50. The upper coupling 44 has a female-threaded portion for being threadedly connected to the sleeve illustrated in FIG. 6.

Figure 5:
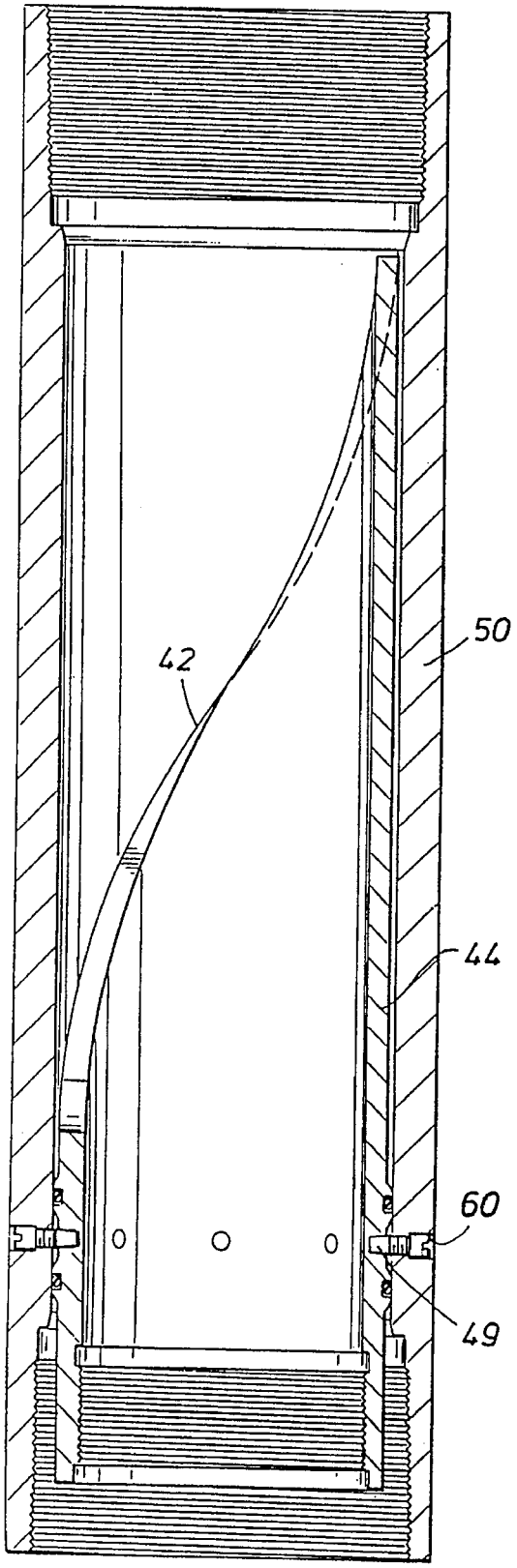
FIG. 5 is an elevated, cross-sectional view of the upper coupling illustrated in FIG. 4, in place in a section of casing.

Referring now to FIG. 5, the upper coupling 44 is illustrated as being pinned to the casing 50 through the use of set screws threaded into the casing holes 60 and the holes 49 in the upper coupling 44.

Figure 6:
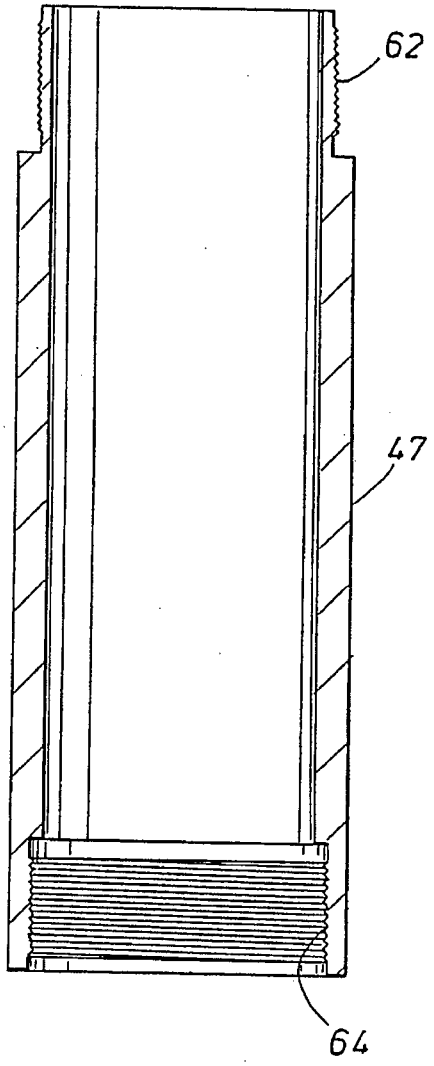
FIG. 6 is an enlarged, elevated, cross-sectional view of the center sleeve portion of the internal pressure sleeve illustrated in FIG. 2.

Referring now to FIG. 6, the sleeve 48 is illustrated in greater detail, having a first pin end (male threads) 62 for threadedly engaging the upper coupler 44 and a second box end (female threads) 64 for threadedly engaging the lower coupling 48.

Figure 7:
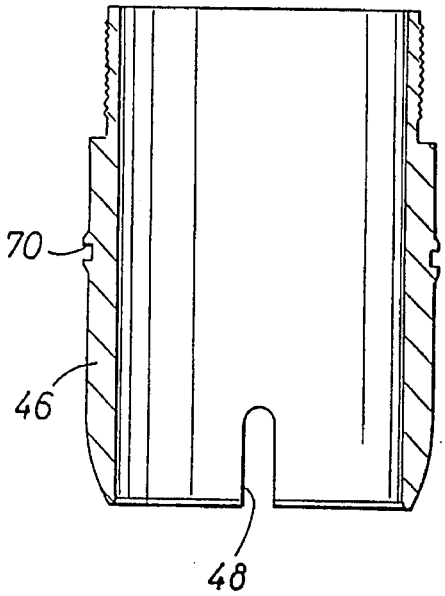
FIG. 7 is an enlarged, elevated, cross-sectional view of the lower coupling portion of the internal pressure sleeve according to FIG. 2.

Referring now to FIG. 7, the lower coupling 46 is illustrated in greater detail. Although only a single O-ring receptacle 70 illustrated, a pair of such receptacles for housing a pair of O-rings such as O-rings 24 and 26 of FIG. 1 can be used if desired.

In the course of practicing the invention, it is contemplated that the following method may be used:

1. Windowed casing joints are placed in the main wellbore casing string and rotated at precise locations, to a predetermined orientation, to allow drilling of multilateral sections through predetermined paths.
2. The main casing string is cemented in place using primary cementing techniques. Alternatively, it may be hung off as a slotted-liner completion.
3. Because the window joint contains an inner-pressure sleeve, securely held in place with O-rings, it can withstand more than normal weight buildup and thus maintain pressure integrity; plus, it also prevents cutting debris from entering the window opening.
4. After cementing the main casing string, the inner-pressure sleeve is retrieved using a standard fishing spear. The cavity created between internal sleeve and composite material is filled with a non-compressible fluid medium and balanced to the external annulus.
5. The retrievable deflection tool (whipstock) is then landed and installed into the casing window joint.
6. The lateral section is drilled using conventional directional drilling techniques—from rotary assemblies to articulated short-radius assemblies, depending on desired wellbore path profile.
7. At TD of the lateral section, the drilling assembly is retrieved (while the whipstock is left in place), and the hole is cleaned to ensure that lateral liner and additional completion equipment can be installed.
8. Next, a lateral liner is run in the hole, to the top of which a lateral hanger assembly and specialized running tool are attached. The entire assembly is run into the wellbore on the end of a drillstring.
9. The running tools are run to depth and the lateral hanger assembly is landed within the window joint.
10. A hydraulic gate closing is activated to close a mechanical gate around the hanger, providing a mechanical seal. Surface pressure-recording equipment monitors the gate-travel and gate-closing process.
11. Next, a hydraulic collet is activated for release, and running tools are released and retrieved to surface.
12. With the retrievable deflection tool (whipstock) still there, the lateral is cemented in place using a cementing re-entry guide tool that allows the liner to be cemented using a dual-plug cement procedure.
13. The retrievable deflection tool (whipstock) is either moved to the next window to aid in drilling another lateral or removed from the wellbore.
14. Now, if needed, the lateral section can be re-entered by landing a completion whipstock in the windowed joint for subsequent operations.

FIG. 8 illustrates a well casing 10 extending down a vertical bore ho into the earth. A preformed exit port or window 12 in the casing opens to a region of drilling interest 30 situated laterally away from the vertical well bore.

A laterally extending bore hole may be drilled to the region 30 using a whipstock assembly W indicated within the casing string 10 which deflects a drill bit B away from the vertical bore through the casing window 12. This basic technique for forming lateral well bores is well established and described in the prior art.

The whipstock assembly W includes an anchoring, positioning and orienting assembly 100 of the present invention secured to the bottom of a whipstock tool 102. The assembly W is suspended from a drill string 103 which extends to the surface. The string 103 is used in conventional fashion as a setting string to raise and lower the assembly as well as to rotate the drill bit B.

Specially configured recesses 105 formed along the interior surface of the casing 10 below the window 12 are designed to align with and receive movable, spring loaded, latches 106 extending radially from the assembly 100. When the latches 106 are properly aligned axially and circumferentially with appropriate recesses in the well casing, the spring loading on the latches forces the latches to move radially outwardly into mating forms in the recesses. By selecting a unique pattern of mating latch and recess dimensions, circumferential orientation as well as axial positioning of the whipstock assembly may be achieved.

Once the assembly W has been anchored and oriented, the drillstring 103 is lowered and simultaneously rotated causing the bit B to advance along the inclined whipstock guide surface and through the window 12 to drill laterally into the surrounding formation in a conventional manner.

Figure 9:
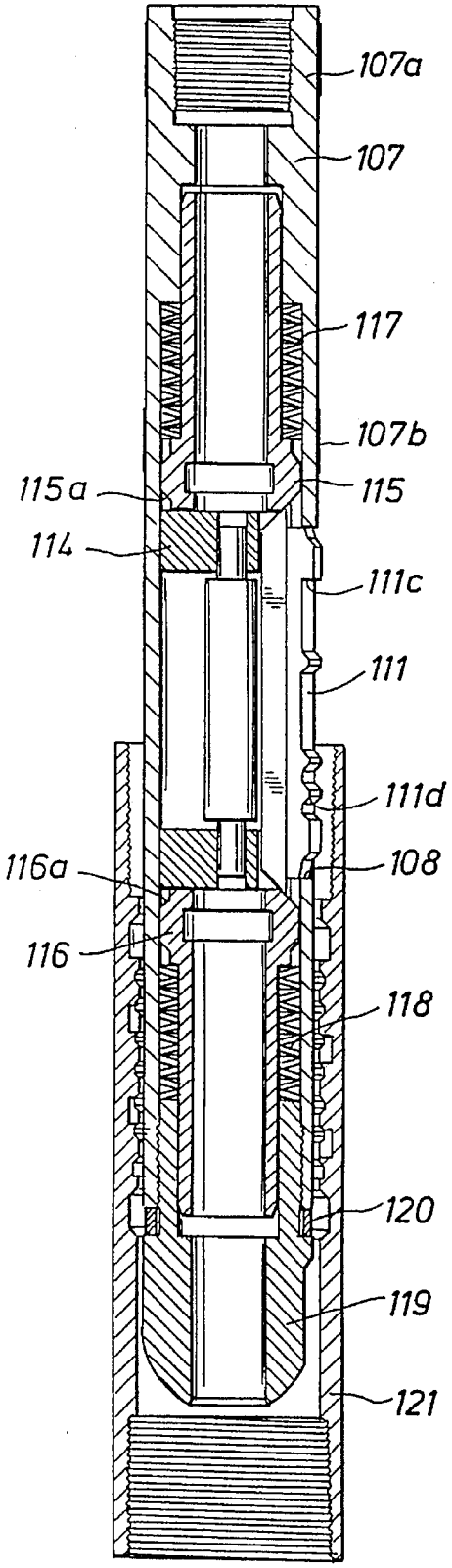
FIG. 9 is a detailed elevation, in cross-section, illustrating the assembly of the invention in its sliding configuration within a recessed casing coupling of the invention.
Figure 10:
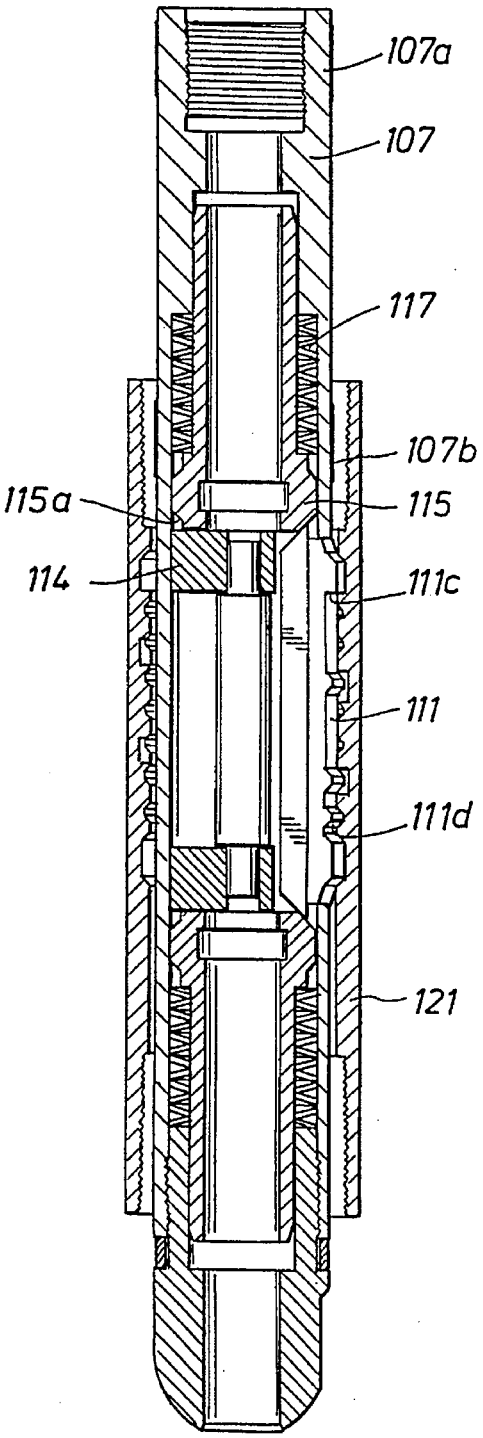
FIG. 10 is a view similar to FIG. 9 illustrating the assembly of the invention in its latched and oriented configuration within the receiving recesses of the surrounding casing coupling.

Details in the construction and operation of a preferred form of the invention may be seen with reference to FIGS. 9 and 10 showing the assembly 100 in its unset or non-anchored configuration (FIG. 9) and its set, oriented configuration (FIG. 10).

Figure 11A:
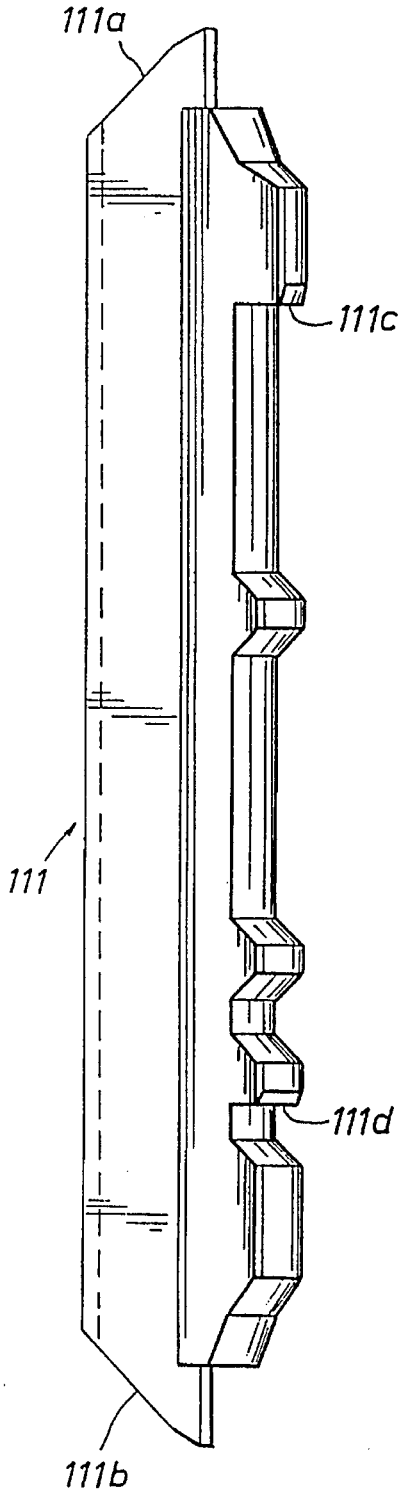
FIGS. 11*a*, 11*b*, and 11*c* are isometric views illustrating details in the profiles of the latches employed in one form of the invention.
Figure 11B:
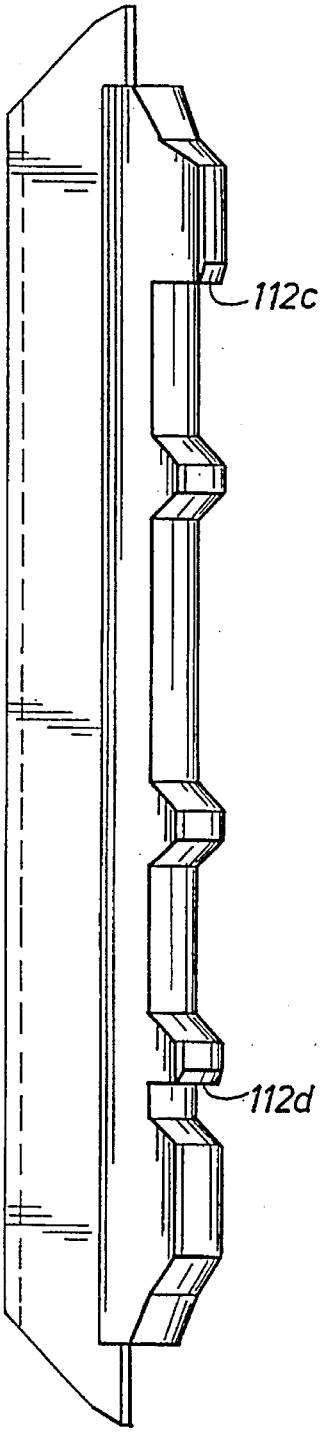
Figure 11C:
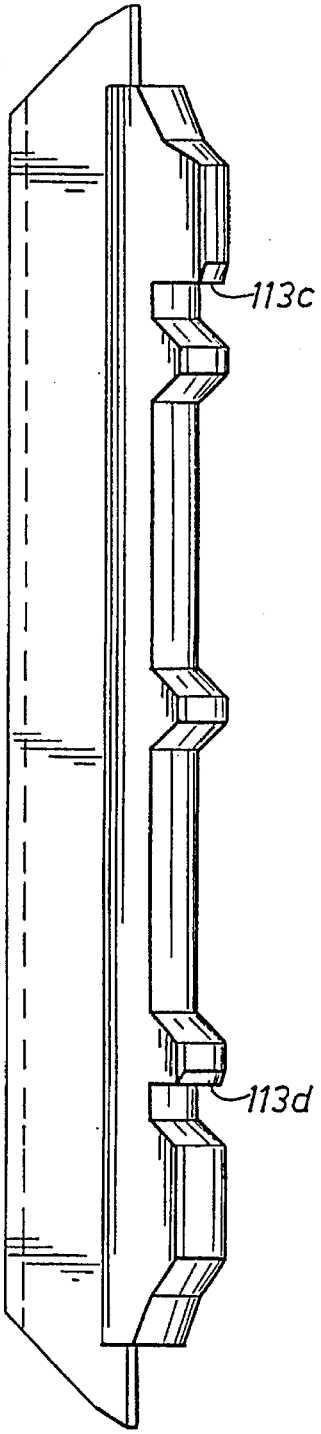
Figure 12:
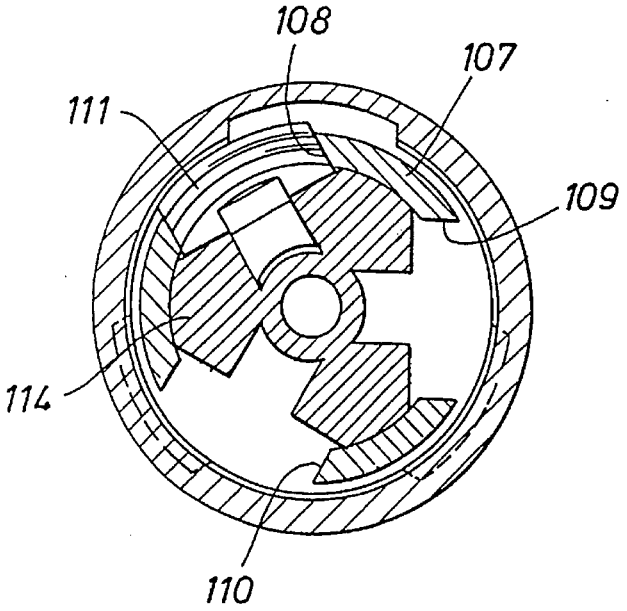
FIG. 12 is a cross-sectional view of the assembly illustrating the configuration of the latches as the assembly is moved through the casing to the area of the receiving recesses.
Figure 13:
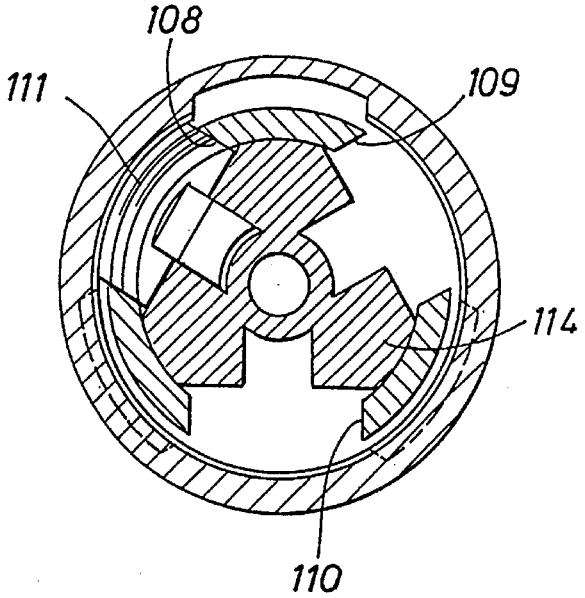
FIG. 13 is a cross-sectional view illustrating the latches of the assembly partially extended as they are initially latched in the casing coupling recesses.
Figure 14:
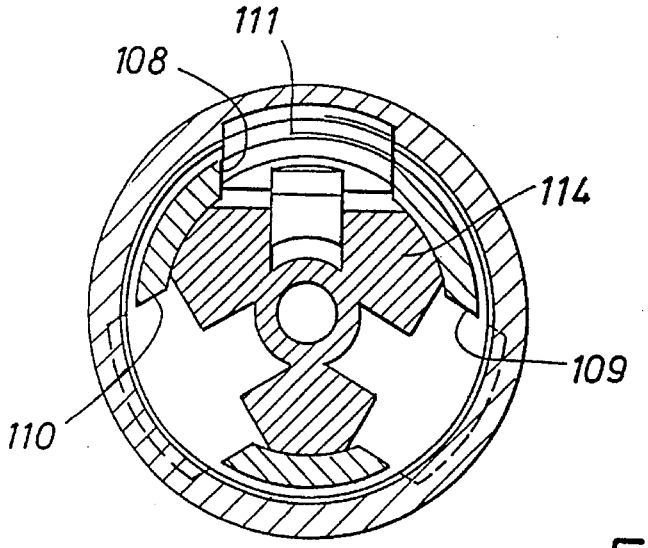
FIG. 14 is a cross-sectional view of the latches of the assembly rotated into their fully extended, latched and oriented positions.
Figure 15:
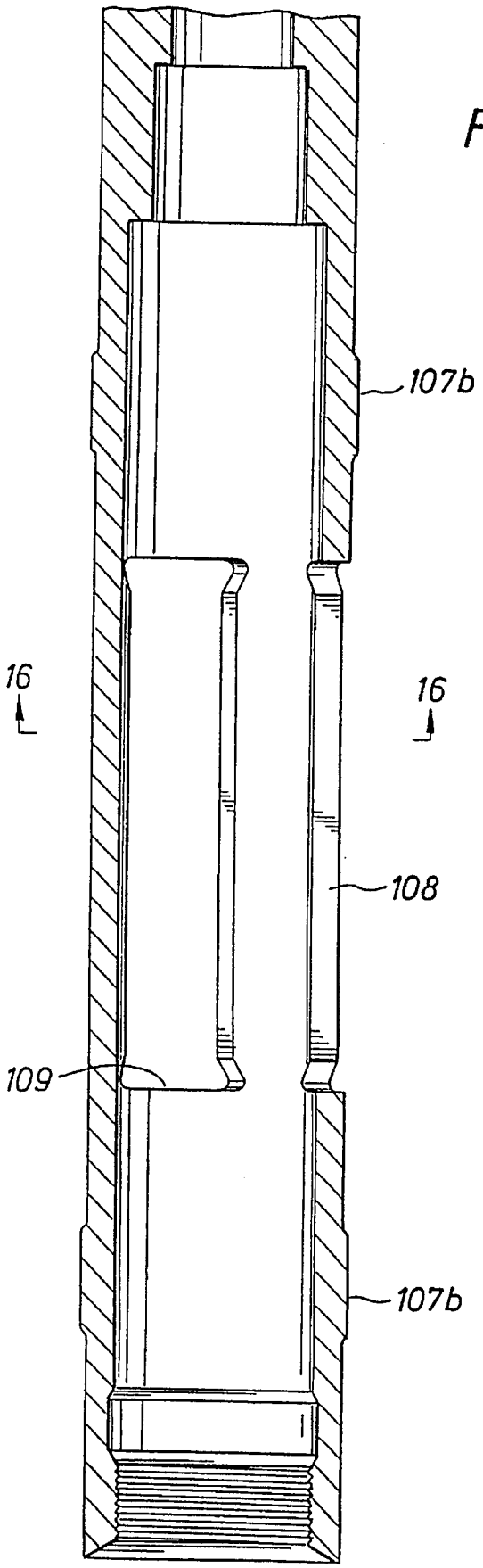
FIG. 15 is a partial vertical cross-sectional view of the latch housing sleeve portion of the assembly of the present invention.
Figure 16:
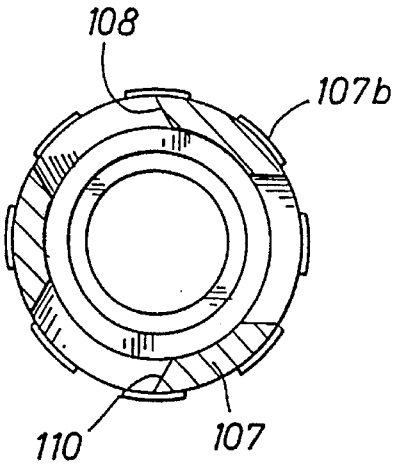
FIG. 16 is a view taken along the line 16—16 of FIG. 15 showing details in the latch housing sleeve.

Referring jointly to FIGS. 9, 12, and 16, the assembly 100 includes a tubular latch housing 107 through which are formed three circumferentially spaced latch windows, 108, 109, and 110. Latches 111, 112, and 113 (FIGS. 11*a*, 11*b*, and 11*c*) are positioned for radial movement through their respective coinciding latch windows as best illustrated in FIG. 12. For clarity, only latch 108 is illustrated in FIGS. 12, 13 and 14.

As illustrated best in FIGS. 9 and 12, the latches are positioned on a latch carrier 114 which holds each latch segment in its respective housing window. The ends of the latches engage spring loaded latch rings 115 and 116 (FIG. 9) which are urged toward each other by two sets of Bellville springs 117 and 118. Tapered surfaces 115*a* and 116*a* on the latch tings 115 and 116, respectively, engage oppositely tapered surfaces such as the surfaces 111*a* and 111*b* (FIG. 11*a*) on the latch segments, to force the latch segments to move radially outwardly.

The assembly 100 is dimensioned to fit snugly against the internal surface of the pipe within which it is to operate so that the latches 111, 112 and 113 are in firm sliding engagement with the internal pipe surface. The amount of force urging the latches outwardly is determined by selecting the appropriate number and strength of elements in the spring assemblies 117 and 118 and by selecting appropriate inclined surfaces for engagement between the latches and the recess contours.

A bull nose nut 119 threadedly engaged to the bottom end of the assembly 100 may be adjusted as required to accommodate different spring configurations. A bull nose spacer 120, having the desired axial length, is positioned between the nut 119 and the housing 107 to permit the nut to be securely tightened onto the housing.

FIG. 16 illustrates protective pads 107*a* positioned about the outer circumference of the housing 107. These pads assist in centering and protecting the latch elements in the assembly as it is lowered through the well pipe.

FIG. 9 illustrates the assembly in its normal "running-in" position as it would be with the latches riding against the nominal (un-recessed) internal surface of the well casing.

FIG. 10 illustrates the assembly in position within a specially recessed casing coupling 121. The coupling 121 is internally threaded at its ends to mate with corresponding external threads formed at the ends of casing joints. The coupling 121 is positioned in the well bore at a known depth and with a known circumferential orientation to function with the assembly 100 in anchoring and orienting a subsurface well tool attached to the upper end 107*a* of the housing 107.

As illustrated in FIG. 17, the coupling 121 is provided with an internally recessed area indicated generally at R which has a series of grooves and slots developed radially outwardly from the coupling's central axis. The result is a specially contoured area where the internal casing diameter is increased relative to the normal internal diameter of the connected casing.

The recessed area R includes slotted sections, S1, S2, and S3 which are only partially developed circumferentially about the internal recessed area R. These slotted sections and their placement are schematically illustrated in FIG. 18. The slots S cooperate with annular grooves G in the recessed area R to provide the unique anchoring and orienting features of the present invention.

As best seen by reference to FIG. 17, the slots S are deeper (extend radially further from the coupling axis) than the grooves G. Additionally, the grooves G extend entirely around the internal surface of the coupling while the slots have limited circumferential development. Each slot set, S1, S2, and S3 also has different axial positioning relative to any other slot set. As may be seen by reference to FIG. 11*a*, 11*b*, and 11*c*, the sliding latch surfaces of the latches 111, 112 and 113 also have profiles which are different from each other.

In operation, when the assembly 100 is lowered into the coupling 121, the latches 111, 112 and 113 partially extend radially into the recess area R as the grooves G are aligned with opposing projecting contours on the latch profiles. When the assembly is rotated, the latches fully extend radially once the latches meet their appropriate slots. Because of the unique match of slots with latches, this occurs at only one circumferential orientation of the assembly 100 within the recessed area R.

As illustrated in FIG. 10, full extension of the latches places square shouldered sections 111*c*, 111*d*, 112*c*, 112*d*, 113*c*, and 113*d* (FIGS. 11*a*, 11*b*, and 11*c*) into engagement with square shoulders formed in the recessed area R to prevent further downward movement of the assembly 100.

During the time the assembly 100 is within the recessed area R but with the latches partially extended but before they have engaged their slots, the assembly 100 can be moved up or down through the coupling by increasing the force exerted through the drill string. The increased force is required to overcome the engagement of the grooves G with the mating projections on the spring loaded latches. This increase in force is measurable at the well surface and provides an indication to the operator that the assembly is in the coupling 121.

Rotation of the drill string 103 to the right aligns the slots and appropriate latches, permitting the latches to spring fully outwardly into the slots. This engagement of slots and latches prevents further rotation of the assembly 100 relative to the coupling 121. The anchored, oriented position is detected at the surface by a sharp increase in the amount of torque being applied to rotate the drill string. Further confirmation of anchoring and orientation is obtained by confirming that the assembly 100 does not move down in response to a downward drill string force equivalent to that which was capable of moving the assembly through the recessed area before orientation.

In an example of a practical application of the invention, the assembly 100 is lowered by the drill string into a well casing until it is in the vicinity of the coupling 121. The operator observing a surface weight indicator notes a decrease of approximately twenty thousand pounds in the string weight coinciding with the latches springing out approximately ⅛" into initial engagement with the recess area R. An upward pull on the drill string is exerted to release the assembly 100. This release force will be seen to exceed the normal, non-engaged weight of the string by approximately 20,000 pounds. This provides confirmation that the assembly has been engaged with the recess area R.

The string is then relowered until the weight indicator again shows a string weight loss of 20,000 pounds. The drill string is rotated to the right until the latches engage and fully expand radially into their respective slot sets. This prevents further assembly rotation which in turn produces a sharp increase in reaction torque which is noted at the surface. This provides confirmation that the assembly has been properly anchored and oriented within the coupling 121. Further confirmation is obtained by resting another 20,000 pounds of string weight on the assembly to ensure that the assembly does not move downwardly. Release of the tool is effected by lifting approximately 40,000 pounds which removes the 20,000 pound test weight and provides the additional 20,000 pounds of force to free from the recesses.

While the preferred embodiment of the invention has been described for use with three latches, it will be appreciated that fewer or more latches may be used without departing from the spirit of the invention. Similarly, the recesses may be formed within the casing itself, a sub assembly or other string component and need not necessarily be formed within a casing coupling.

It will further be understood that various means may be provided to produce the biasing force which urges the latches outwardly. Also, while slots and grooves and matching latch contours have been described in the preferred form of the invention, other techniques for ensuring that only specific elements of the assembly 100 will mate with corresponding elements of the coupling 121 to produce a two step radial expansion and a non-rotatable orientation may be employed.

What is claimed is:

1. An assembly for anchoring and orienting a well tool at a subsurface location in a well tube, comprising:

(a) tubular receiving means located at a first subsurface location within said tube;

(b) a first recessed area on the internal surface of said tubular receiving means providing increased internal diametrical clearance within said recessed area relative to the clearance of said tube;

(c) a second, further recessed, area functionally connected with said first recessed area providing a greater diametrical internal clearance within said tube, said second recessed area being located at a defined, limited, circumferential position on the internal surface of said tube;

(d) outwardly biased, radially movable latch means for anchoring and orienting said well tool within said receiving means, said latch means being moveable longitudinally through said tube from the surface to the subsurface location of said receiving means;

(e) a first contour on the external face of said latch means for meshing engagement with corresponding receiving contours formed in said first recessed area whereby said latch means is moveable outwardly into meshing position with said first recessed area when said latching means and said first recessed area are aligned longitudinally;

(f) a second contour on the external face of said latch means for meshing engagement with corresponding receiving contours formed in said second recessed area whereby said latch means is moveable radially outwardly beyond its radial movement into said first recessed area; and (g) rotational stopping means included with said second recessed area to engage and limit rotational movement of said latch means within said receiving means.

2. An assembly as defined in claim 1, wherein said first recessed area includes circumferentially developed grooves extending fully about the internal circumference of said receiving means.

3. An assembly as defined in claim 1, wherein said second recessed area includes slots extending only partially about the internal circumference of said receiving means.

4. An assembly as defined in claim 2, wherein said second recessed area includes slots extending only partially about the internal circumference of said receiving means.

5. An assembly as defined in claim 3, wherein said rotational stopping means includes square shouldered engaging means between said latch means and said slot means.

6. An assembly as defined in claim 4, wherein said rotational stopping means includes square shouldered engaging means between said latch means and said slot means.

7. An assembly for anchoring and orienting a well tool at a subsurface location comprising:

(a) an internally slotted and grooved tubular receiving segment adapted to be contained at a subsurface location as part of a well pipe;

(b) a latch assembly carrying latch means and adapted to be lowered through said well pipe to said tubular receiving segment;

(c) spring biasing means for urging said latch means radially outwardly into engagement with the internal surface of said receiving segment;

(d) an area of internally formed grooves on the internal surface of said receiving segment;

(e) a pattern of axially extending slots formed within said grooved area, said slots having bases with greater radial distance away from the center line of said receiving segment that the bases of said grooves; and (f) groove matching and slot matching contours formed on the radially outer surfaces of said latch means whereby said latch means are permitted to extend radially outwardly when said groove and slot contours coincide with corresponding contours on the internal surface of said receiving segment.

8. An assembly as defined in claim 7, said latch means including at least two latching members with each member having groove and slot matching contours which differ from those of the other member.

9. An assembly as defined in claim 8, further including:

(a) three or more circumferentially spaced latching members, each such member having groove and slot matching contours which are different from those of the other members; and (b) three or more circumferentially spaced slot sets in said grooved area, each such slot set having a configuration which will accept the mating configuration of only one of said latching members.

10. An assembly as defined in claim 9, further including:

(a) latch carrying means for supporting said latch members for radial movement within said latching means;

(b) opposing spring biasing means acting on tapered end surfaces on said latch members for providing radially outwardly exerted biasing forces on said latch members; and (c) downwardly directed square shoulder contours on said latch members for engagement with upwardly directed square shoulder contours in said grooved area to prevent downward motion of said latch means when said latch members meet with their appropriate slot sets and spring into their radially outermost position.

11. An assembly as defined in claim 10, further including tapered upwardly directed end surfaces on said latch members adapted to engage tapered downwardly directed surfaces on said grooves and slots whereby said latch members are forced to retract radially inwardly when said latch means is pulled upwardly through said grooved area.

* * * * *

UNITED STATES PATENT AND TRADEMARK OFFICE

CERTIFICATE OF CORRECTION

PATENT NO. : 5,579,829

DATED : December 3, 1996

INVENTOR(S) : Laurier E. Comeau; Elis Vandenberg

It is certified that error appears in the above-indentified patent and that said Letters Patent is hereby corrected as shown below:

In column 10, line 38, delete "that" and insert therefor —than—.

Signed and Sealed this

Twenty-fifth Day of February, 1997

*Attest:*

*Attesting Officer*

BRUCE LEHMAN

*Commissioner of Patents and Trademarks*